US009390575B1

(12) United States Patent
Clark

(10) Patent No.: US 9,390,575 B1
(45) Date of Patent: Jul. 12, 2016

(54) CANISTER DISTRIBUTION SYSTEM

(71) Applicant: ANYTIME PROPANE, LLC, Chickasha, OK (US)

(72) Inventor: James P. Clark, Chickasha, OK (US)

(73) Assignee: ANYTIME PROPANE, LLC, Chickasha, OK (US)

( * ) Notice: Subject to any disclaimer, the term of this patent is extended or adjusted under 35 U.S.C. 154(b) by 244 days.

(21) Appl. No.: 14/104,866

(22) Filed: Dec. 12, 2013

(51) Int. Cl.

| | |
|---|---|
| ***G07F 17/00*** | (2006.01) |
| ***G07F 7/06*** | (2006.01) |
| ***G07F 9/02*** | (2006.01) |
| ***G07F 5/26*** | (2006.01) |

(52) U.S. Cl.
CPC ..... *G07F 7/0609* (2013.01); *G07F 5/26* (2013.01); *G07F 7/06* (2013.01); *G07F 9/026* (2013.01)

(58) Field of Classification Search
None
See application file for complete search history.

(56) References Cited

U.S. PATENT DOCUMENTS

| | | | | |
|---|---|---|---|---|
| 3,039,583 | A | 6/1962 | Menefee | |
| 3,179,224 | A | 4/1965 | Haupt, Sr. et al. | |
| 5,544,784 | A | 8/1996 | Malaspina | |
| 5,829,630 | A * | 11/1998 | Fernald | G07F 7/0609 193/35 S |
| 6,206,237 | B1 | 3/2001 | Dillon et al. | |
| 6,761,194 | B1 | 7/2004 | Blong | |
| D545,373 | S | 6/2007 | Steffens | |
| 7,975,875 | B2 | 7/2011 | Borzym | |
| 8,360,272 | B2 | 1/2013 | Piersant et al. | |
| 8,387,823 | B2 * | 3/2013 | Davis, Jr. | G07F 7/0609 221/102 |
| 8,469,228 | B2 | 6/2013 | Adams | |
| 2004/0245278 | A1 | 12/2004 | Steffens et al. | |
| 2007/0170201 | A1 | 7/2007 | Steffens | |
| 2008/0083769 | A1 * | 4/2008 | Yuyama | G06Q 50/22 221/1 |
| 2009/0084810 | A1 * | 4/2009 | Borzym | A47F 1/087 221/66 |
| 2009/0145919 | A1 * | 6/2009 | Dueck | G07F 11/58 221/119 |
| 2012/0222938 | A1 * | 9/2012 | Rose, Jr. | G06Q 20/18 198/572 |

FOREIGN PATENT DOCUMENTS

| | | |
|---|---|---|
| EP | 1396823 | 3/2004 |
| ES | 2158816 | 3/2002 |
| FR | 2888380 | 1/2007 |
| GB | 2251609 | 7/1992 |
| WO | WO2004090357 | 10/2004 |
| WO | WO2007100400 | 9/2007 |
| WO | WO2010130913 | 11/2010 |
| WO | WO2012131132 | 10/2012 |
| WO | WO2013074915 | 5/2013 |

OTHER PUBLICATIONS

Siraga Distrigas. Siraga Vending Machine Solutions Distrigas. You Tube. Mar. 26, 2012. [retrieved on Jan. 29, 2015], Retrieved from internet: <URL:https://www.youtube.com/watch?v=Zd8Z2XRoWdo>. Entire video.

PCT/US14/067486, Anytime Propane, LLC, International Search Report dated Feb. 20, 2015.

(Continued)

*Primary Examiner* — Prasad Gokhale
(74) *Attorney, Agent, or Firm* — McAfee & Taft, A Professional Corporation

(57) ABSTRACT

A self-service kiosk for storing and dispensing canisters is provided. The kiosk has an automated teller and a canister storage compartment. The canister storage compartment has a series of walls defining an enclosure for storage and dispensing of canisters and a plurality of horizontally extending canister rows within each enclosure. Each row is configured to hold a line of at least three canisters such that a full canister can be dispensed from one end of the row and a canister can be returned at the other end of the row. As canisters are dispensed, the line of canisters is pushed towards the dispensing end of the row.

20 Claims, 11 Drawing Sheets

(56) References Cited

OTHER PUBLICATIONS

Siraga Distrigas. Siraga Vending Machine Solutions Distragas. YouTube. Mar. 26, 2012. [retrieved on Jan. 29, 2015]. Retrieved from internet: <URL:https://www.youtube.com/watch?v=Xd8Z2XRoWdo>. Entire video.

PCT/US2014/067486, Anytime Propane, LLC International Search Report dated Feb. 20, 2015.

* cited by examiner

CANISTER DISTRIBUTION SYSTEM

FIELD OF THE INVENTION

The present invention relates generally to the vending of canisters through automated kiosk or vending machines and has particular relevance to the sale and/or exchange of propane canisters or tanks.

BACKGROUND

Some products are delivered and sold in containers for use by customers. For example propane is often sold in containers that are valved cylinders such as the type typically used for outdoor grills. These valved cylinders have a cylindrically shaped tank, a base-mounted to the bottom of the tank, a valve at the top of the tank, and a guard substantially encircling the valve and providing a pair of lifting handles. The base and the guard have diameters smaller than the diameter of the outer surface of the tank. Because of the specific nature in which such canisters must be filled, the equipment needed to fill the tanks and the highly combustible nature of propane, it is generally required that a professional fill a user's propane tank.

Accordingly, for propane and similar products, empty canisters are exchanged for full ones. Generally, when a propane canister is empty (i.e. substantially out of propane or another product), a user brings their canister to a particular store and exchanges their empty canister for a full canister (i.e. full or substantially full of propane or another product). A cashier generally assists the user in ensuring that the user exchanges their empty canister for a different full canister. The full and empty propane canisters may be kept in various secure locations (e.g. locked cage, etc.). Additionally, the propane canisters are generally also stored outside the store for various safety reasons.

Exchanging the propane canisters can be a hassle for the businesses that handle the canisters in that the cashier may have to leave their register to go and exchange the canisters. This can also result in customers waiting at the register unassisted or the businesses needing to constantly ensure that an employee is available to exchange propane tanks. For these as well as other reasons, various attempts have been made to automate the process of obtaining or exchanging canisters such as propane canisters. Unfortunately, these automated canister distribution system have generally been insufficient to meet the needs of the market. Often they require the participation of a cashier or other store personnel and, thus, represent no advantage over traditional manual canister cages. Also, some systems have failed to effectively address the issues related to preventing a purchaser from removing more than one full canister or an empty canister from the automated system or from preventing a purchaser from returning false or fake empty canisters. For these and other reasons, there is a demand for a more practical and efficient system for obtaining a full propane canister or exchanging an empty canister for a full canister.

SUMMARY

In one embodiment there is a process for dispensing canisters comprising the steps of:

(a) receiving a payment at an automated teller spaced apart from one or more canister storage compartments, wherein each such canister storage compartment has a plurality of horizontally extending canister rows configured to hold at least three canisters such that there is a line of canisters along the row, wherein the payment initiates a canister transaction;

(b) receiving a series of instructions at the automated teller including whether a return canister will be returned and, if no return canister is to be returned, skipping steps (d), (e) and (f);

(c) selecting a canister row from a set of canister rows, wherein the set of canister rows comprises one or more of the horizontally extending canister rows;

(d) opening a first door at a receiving end of the selected row of the canister storage compartment, wherein the receiving end has a receiving space suitable to receive the return canister;

(e) closing the first door;

(f) detecting whether the return canister is present in the receiving space and continuing to step (g) if the return canister is detected or proceeding to step (j) if no return canister is detected;

(g) opening a second door at a dispensing end of the selected row to allow access to a full canister in a dispensing space;

(h) closing the second door;

(i) detecting whether the full canister is in the dispensing space and if the full canister is still detected proceeding to step (j); and (j) modifying the canister transaction if no return canister is detected in step (f) or if the full canister is detected in step (i).

In another embodiment there is provided a self-service kiosk for storing and dispensing canisters. The kiosk comprises an automated teller and a canister storage compartment. The canister storage compartment has a series of walls defining an enclosure for storage and dispensing of canisters. The series of walls includes a front wall.

Also, the canister storage compartment has a plurality of horizontally extending canister rows within the enclosure. Each row is configured to hold a line of at least three canisters and each row has a dispensing end defining a dispensing space and a receiving end defining a receiving space. The front wall has a receiving door at the receiving end of each row and a dispensing door at the dispensing end of each row. The kiosk can have a plurality of such canister storage compartments and each canister storage compartment can have three horizontally extending canister rows.

The canister storage compartment includes a canister pusher associated with each row such that the canister pusher can push the canisters in the row associated with it towards the dispensing end based on a moving signal from the automated teller.

Also, the canister storage compartment includes a first canister lock and a second canister lock associated with each row. The first canister lock has a lock mode and an unlock mode. The first canister lock is mounted in the enclosure and adjacent to the dispensing end such that, when in the lock mode, it prevents the canister adjacent to the dispensing space from being removed. The second canister lock has a lock mode and an unlock mode. The second canister lock is mounted in the enclosure and adjacent to the receiving end such that, when in the lock mode, it prevents the canister adjacent to the dispensing space from being removed.

Further, the canister storage compartment has a door opener associated with each dispensing door and each receiving door. The door opener opens or closes the door associated with it, based on an opening signal from the automated teller.

The canister storage compartment can have a return sensor and dispensing sensor. The return sensor is associated with the receiving end of each row. The return sensor is configured to detect when a return canister is placed in the receiving space and send a return signal to the automated teller. The dispensing sensor is associated with the dispensing end of each row. The dispensing sensor is configured to detect when a canister has been removed from the dispensing space and send a dispensing signal to the automated teller.

The automated teller is in communication with each canister pusher such that it can send the moving signal, each pneumatic door opener such that it can send the opening signal, each return sensor such that it can receive the return signal, and each dispensing sensor such that it can receive the dispensing signal.

In a further embodiment there is provided a method of deploying a self-service kiosk for storing and dispensing canisters. The kiosk comprises an automated teller unit and a first canister storage unit, the method comprising:

(a) transporting the kiosk to an installation site having a ground surface, wherein the automated teller unit is in a transportation position in which the automated teller unit is adjacent to the canister storage unit, the automated teller unit being slidably connected to the canister storage unit such that it has the transportation position and a dispensing position in which it is spaced 60 to 240 inches from the canister storage unit;

(b) placing the kiosk on the ground surface; and (c) placing the automated teller unit into the dispensing position.

In yet another embodiment there is provided a door apparatus comprising a door frame, a door, a pneumatic piston and a ratcheting claw. The door slidingly engages the door frame such that the door can be moved between an open position and a closed position. The pneumatic piston is configured to open and close the door. The ratcheting claw engages the door and door frame such that the ratcheting claw prevents the door from being forced to a fully open position from a partially closed position.

BRIEF DESCRIPTION OF THE DRAWINGS

These and further features will be apparent with reference to the following descriptions and drawings.

FIG. 5 illustrates the receiving end of the canister storage compartment with partial cutaway such that the upper and middle horizontal rows can be seen. The upper horizontal row is shown with canisters and the middle horizontal row is shown without canisters.

FIG. 6 is a plane view of an embodiment of the canister storage compartment. FIG. 6 illustrates the dispensing end of the canister storage compartment with partial cutaway such that the upper and middle horizontal rows can be seen. The upper horizontal row is shown with canisters and the middle horizontal row is shown without canisters.

FIG. 9 is a diagram illustrating an overview of the use of a self-service kiosk in accordance with one embodiment.

DETAILED DESCRIPTION

Figure 1:
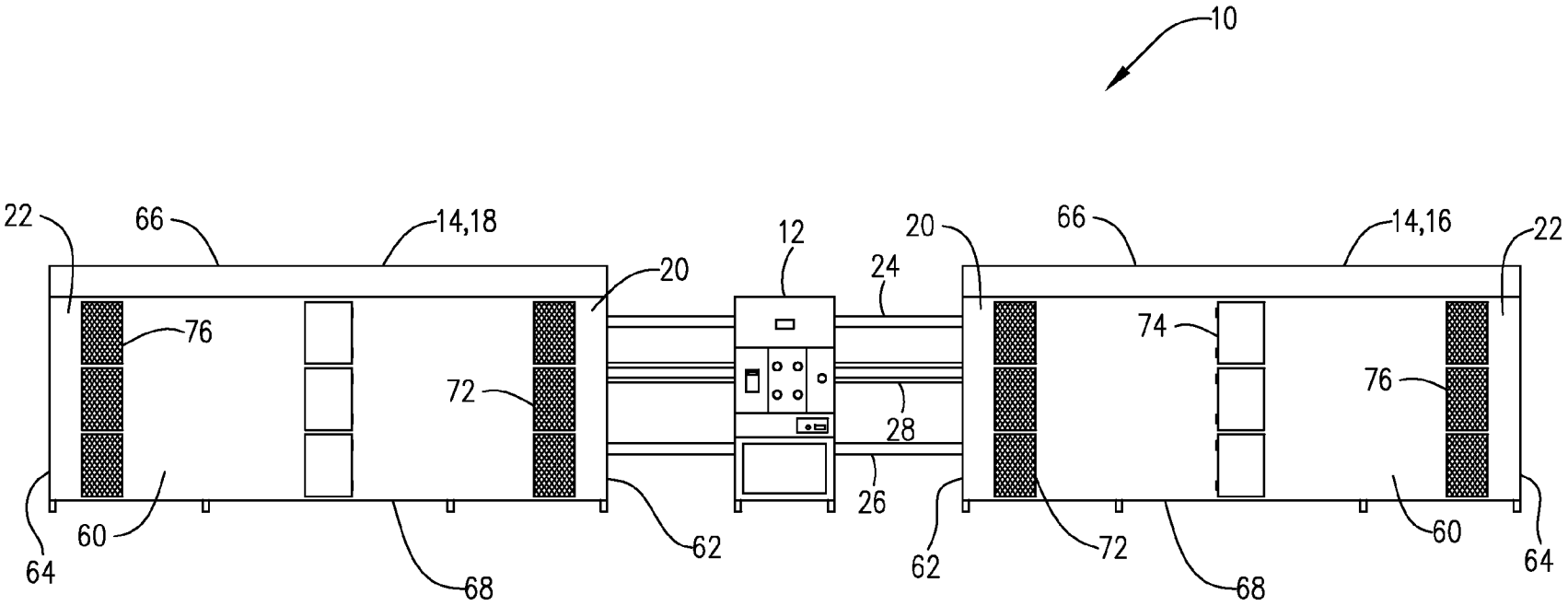
FIG. 1 is a plane view of one embodiment of a self-service kiosk for dispensing canisters having a first and second canister storage compartment.

In the description that follows, like parts are marked throughout the specification and drawings with the same reference numerals, respectively. The drawings are not necessarily to scale and the proportions of certain parts have been exaggerated to better illustrate details and features of the invention. In the following description, the terms "upper," "upward," "lower," "below," and the like as used herein shall mean in relation to the natural orientation of the embodiment shown even though alternative embodiments may deviate from the orientation. The terms "inwardly" and "outwardly" are directions toward and away from, respectively, the geometric center of a referenced object. Where components of relatively well-known designs are employed, their structure and operation will not be described in detail.

Figure 2:
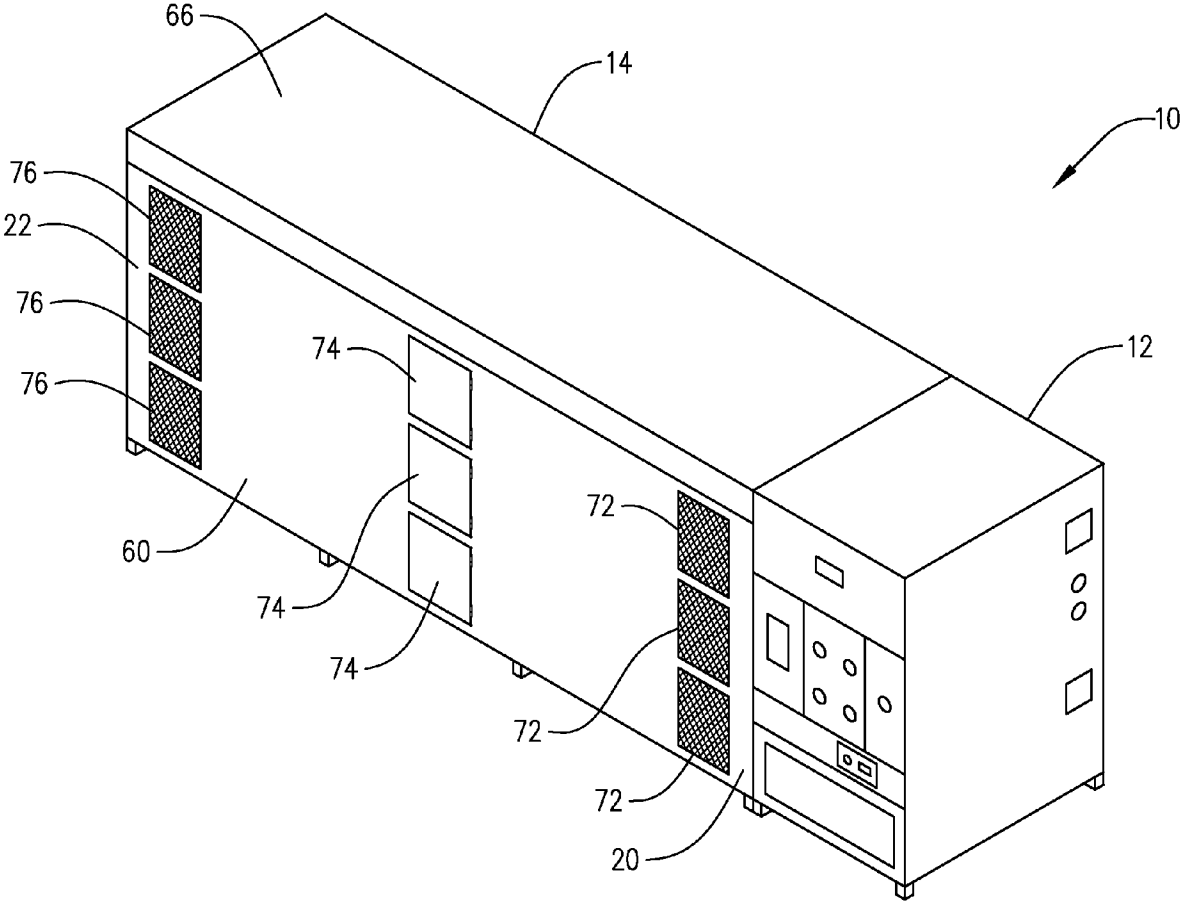
FIG. 2 is a perspective view of an embodiment of a self-service kiosk for dispensing canisters having a single canister storage compartment. The kiosk is shown with the automated teller unit in the transportation position.
Figure 3:
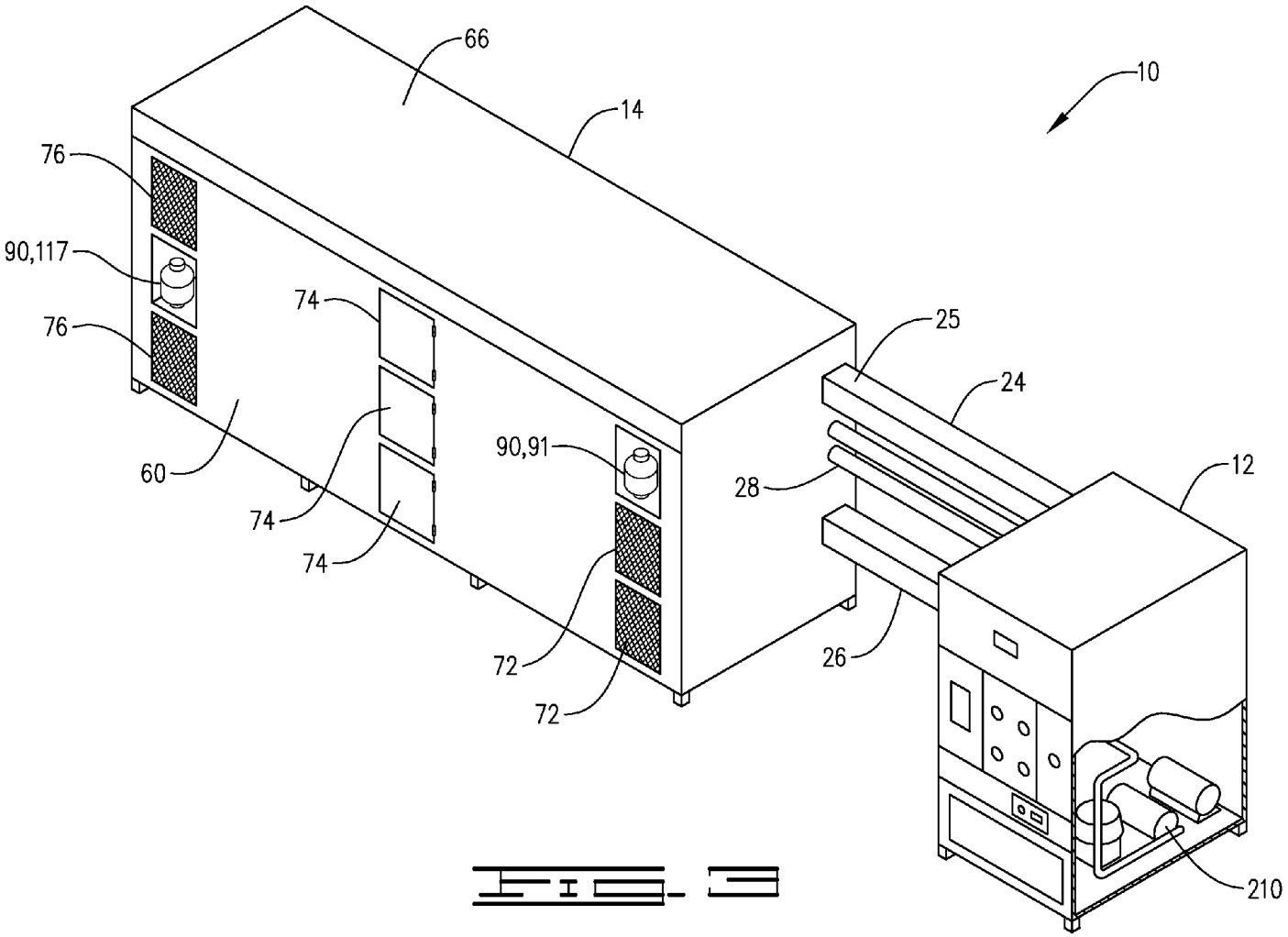
FIG. 3 is a perspective view of the embodiment of FIG. 2 shown with the automated teller unit in the dispensing position.

FIGS. 1-3 illustrate a self-service kiosk 10 for dispensing canisters; that is, a canister vending machine of the type suitable for dispensing propane canisters or other similar canisters. The kiosk generally comprises an automated teller unit 12 and one or more canister storage compartments 14, each having a receiving end 20 and a dispensing end 22. FIG. 1 shows the kiosk having a first canister storage compartment or unit 16 and a second canister storage compartment unit 18. Generally, automated teller unit 12 can be capable of controlling four canister storage compartments and, thus, in addition to those shown in FIG. 1 there could be a third canister storage unit connected and a fourth canister storage unit. Typically, if used, the third canister storage unit can have its receiving end connected to the dispensing end 22 of first canister storage unit 16. Similarly, the fourth canister storage unit can have its receiving end connected to dispensing end 22 of second canister storage unit 18. Other arrangements will be apparent to those skilled in the art.

Automated teller unit 12 is connected to both first canister storage unit 16 and second canister storage unit 18 by beams 24 and 26 and tube 28. Beams 24 and 26 structurally connect automated teller unit 12 to first and second canister storage units 16 and 18 to prevent movement of the automated teller unit 12 separate from the two storage units. Tube 28 provides for communication leads, such as wires and pneumatic lines, to extend between automated teller 12 and the canister storage units. Although a separate tube 28 is shown in the embodiments, it is within the scope of the invention for either or both of the beams 24 and 26 to serve as tube 28. Additionally, more or less beams can be used, as are necessary to achieve a suitable structural connection.

Figure 4:
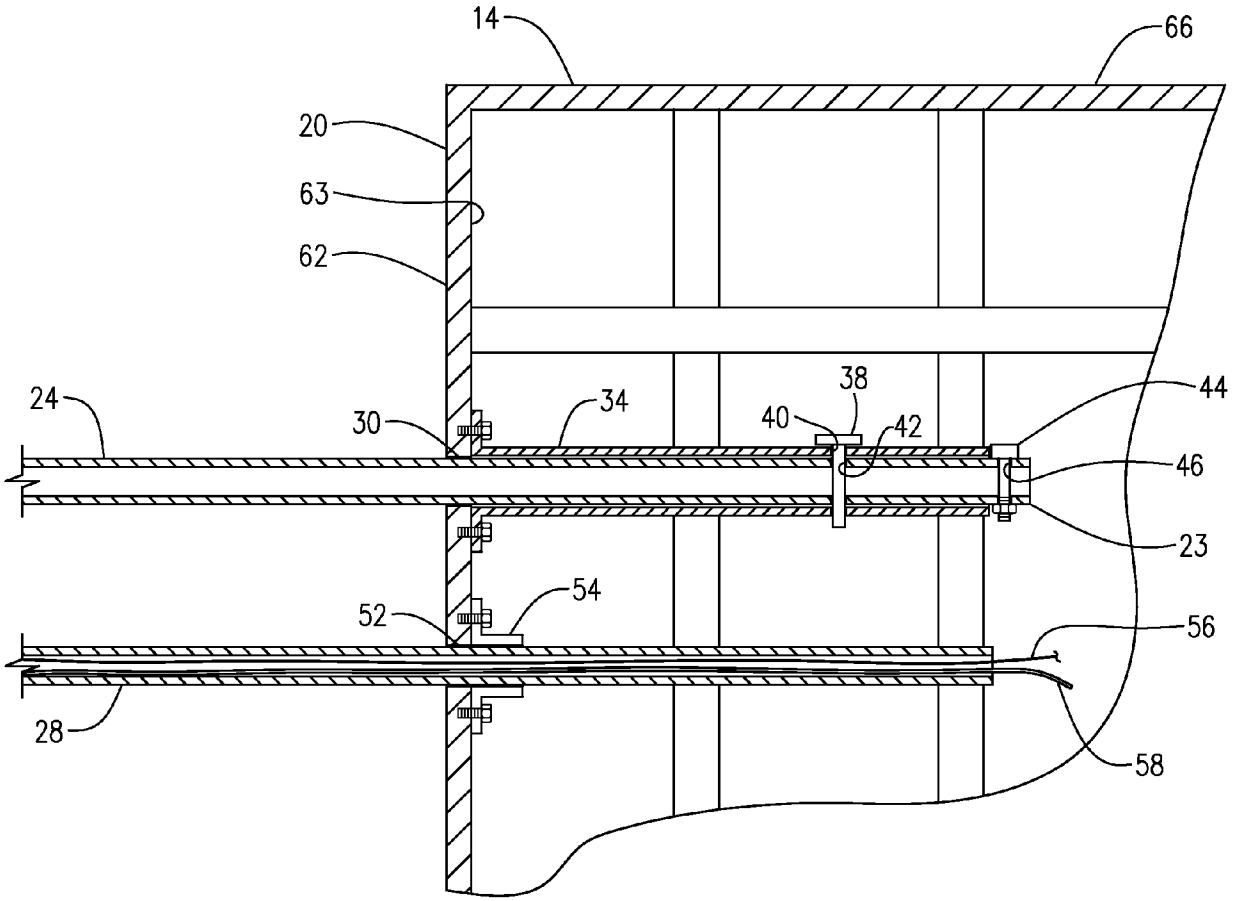
FIG. 4 is a sectional view of one wall of the canister storage compartment illustrating the attachment of the automated teller unit to the canister storage compartment.

Turning now to FIGS. 2, 3 and 4 the attachment of the automated teller unit 12 to a canister storage compartment 14 will be further explained. Automated teller unit 12 can be slidably connected to at least one canister storage compartment 14 in a manner to allow it to have a transportation position and dispensing position. In the transportation position, automated teller unit 12 is adjacent to canister storage compartment 14 (see FIG. 2). Typically, automated teller unit 12 will abut canister storage compartment 14 or, in other words, in the transportation position, automated teller unit 12 is held in a position pressed up against canister storage compartment 14 so as to facilitate loading, transportation and unloading of the kiosk. In the dispensing position, automated teller unit 12 is spaced from the canister storage compartment 14. Such spacing isolates the electronic components and pneumatic compressors from the canister storage compartment where they might prove to be problematic especially when the canisters to be dispensed contain propane or a similar flammable fluid. Typically the spacing will be greater than about 60 inches and more typically from 60 to 240 inches.

With reference to FIG. 4, one embodiment of a suitable slidable attachment is illustrated. The slidable attachment comprises a first beam 24 and second beam 26. The arrangement of each beam is similar and, thus, only beam 24 is shown in FIG. 4 and described herein. Beam 24 is received in an aperture 30 defined by a wall of canister storage compartment 14. Here the aperture is shown as being in wall 62 at the receiving end 20. Attached to the inside portion 63 of wall 62, that is on the inside of canister storage compartment 14, is beam brace 34. Beam brace 34 is a hollow tube that attaches to the portion 63 of wall 62 at aperture 30 so that its hollow interior aligns with aperture 30 and can slidably receive a first end 23 of beam brace 24. A second end 25 of beam 24 is securely attached to automated teller unit 12. Beam 24 is shown in its extended position; thus, automated teller 12 would be in its dispensing position as opposed to in the transportation position where beam 24 would be in its retracted position such that it is substantially within canister storage compartment 14. Pin 38 is shown extending through an aperture 40 in beam brace 34 and through aperture 42 in beam 24 so as to anchor or lock beam 24 and, hence, automated teller 12 to secure them against movement relative to canister storage compartment. Additionally or alternatively to pin 38, end bolt 44 can be used to lock and secure beam 24. End bolt 44 extends through and aperture 46 in beam 24 and abuts beam brace 34 to thereby prevent outward movement of beam 24.

As can additionally be seen from FIG. 4, tube 28 slidably extends through an aperture 52 in wall 62 and is supported by a collar 54. Tube 28 carries wires or electrical lines 56 and pneumatic tubes or lines 58 through its interior. Pin 38 and bolt 44 are removed to place automated teller unit 12 in its transportation position where beam 24 and tube 28 are slid further into canister storage compartment 14 to allow automated teller unit 12 to slide adjacent to canister storage compartment 14.

An embodiment of the canister storage compartment will now be described with reference to FIGS. 1-3, and 5-7. Canister storage compartment or canister storage unit 14 comprises a series of walls; front wall 60, a side wall 62 at receiving end 20, a side wall 64 at dispensing end 22, top wall 66; a bottom wall 68 and a back wall 70, as can best be seen from FIGS. 5, 6 and 7. The walls define an enclosure for the storage and dispensing of canisters. Front wall 60 has receiving doors 72 at receiving end 20, dispensing doors 76 at dispensing end 22 and maintenance doors 74 approximately mid-way between receiving end 20 and dispensing end 22. It is within the scope that the doors be located at other positions, such as locating maintenance doors 74 on back wall 70; however, for accessibility reasons as well as ease of operation, the illustrated locations are preferred.

Figure 5:
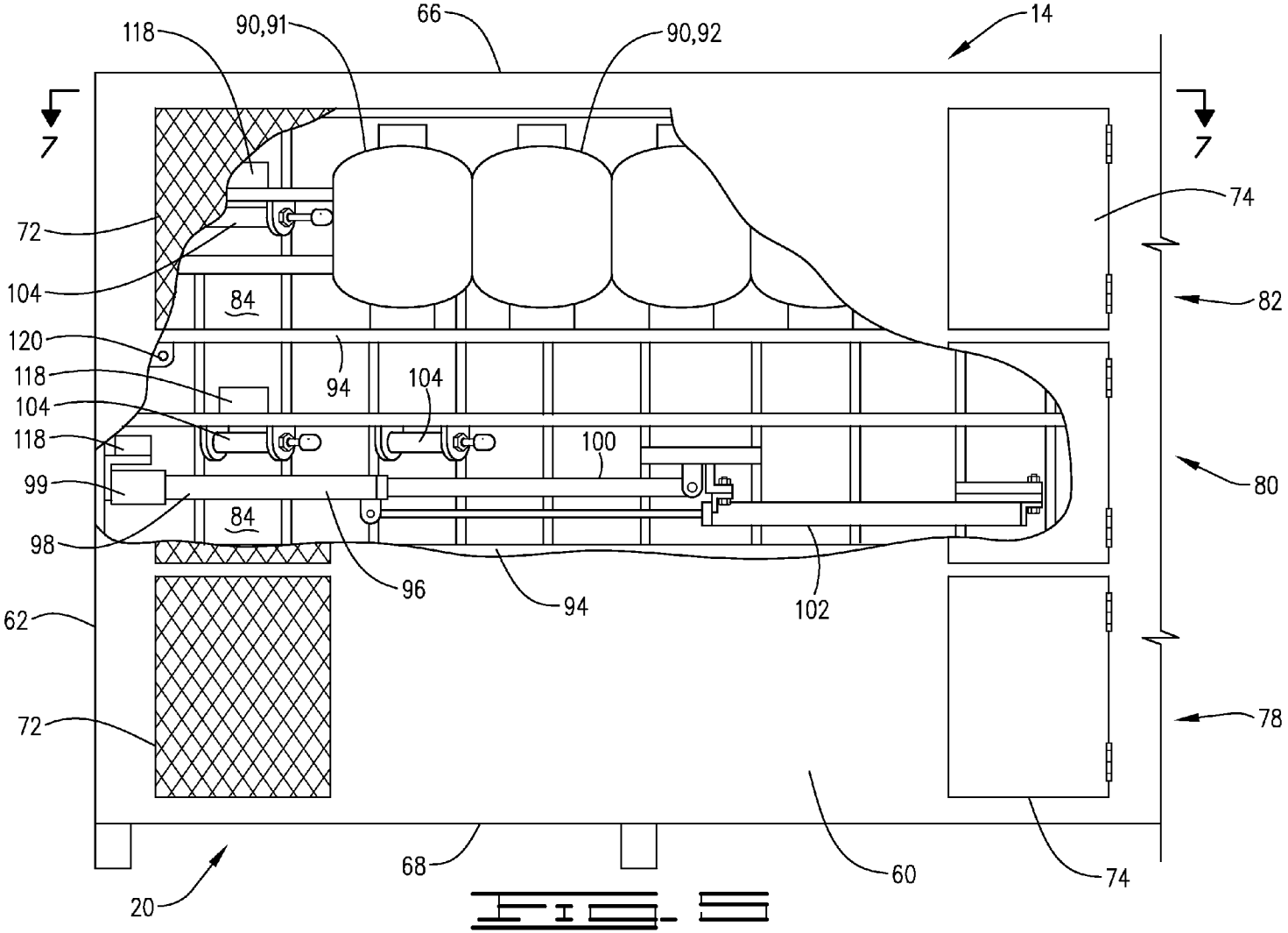
FIG. 5 is a plane view of an embodiment of the canister storage compartment.
Figure 11:
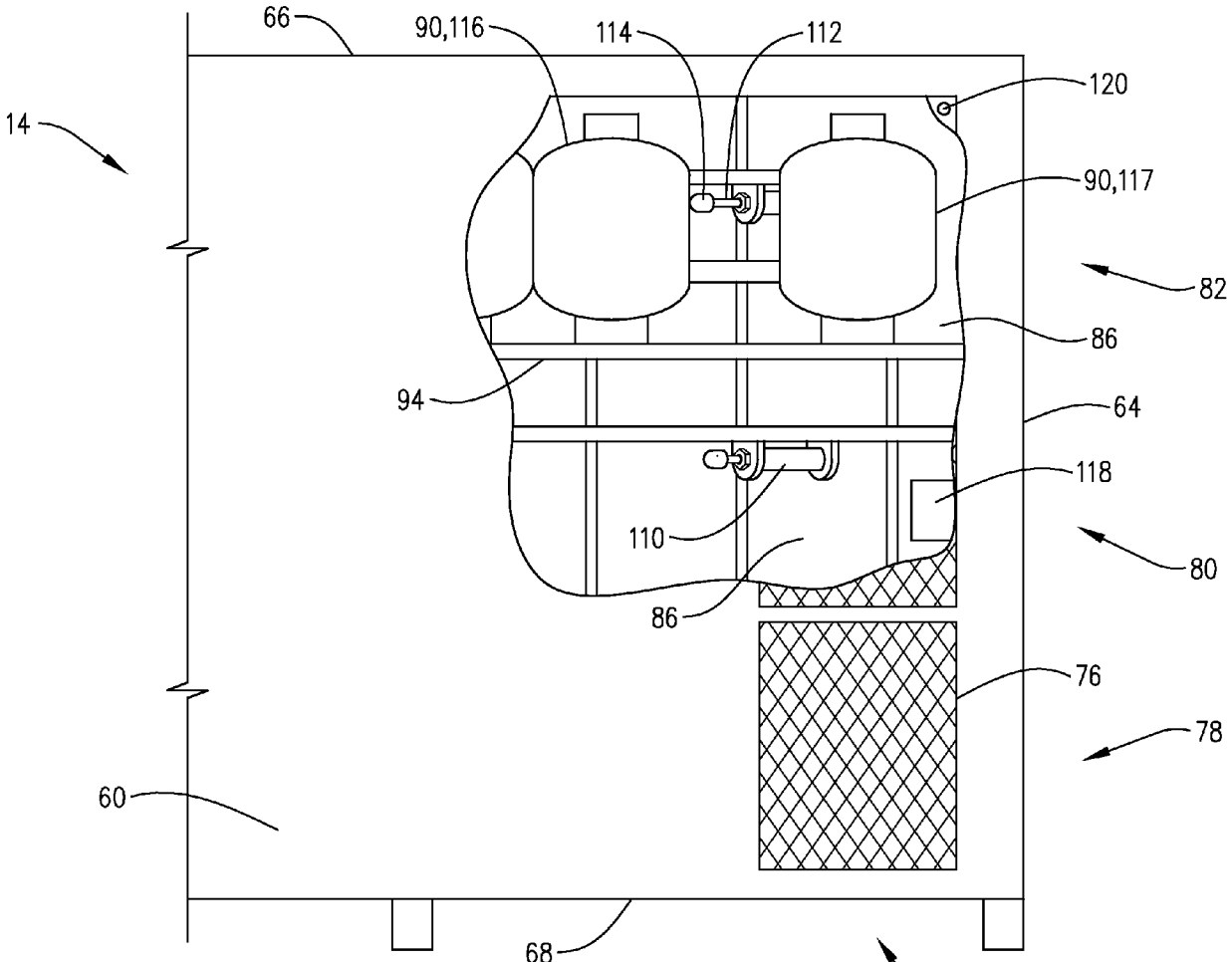

Canister storage compartment 14 typically has a plurality of horizontally extending canisters rows. Generally, the horizontally extending canister rows for each storage compartment 14 will be vertically stacked. As illustrated, there are three such rows an upper row 82, a middle row 80 and lower row 78, as indicated by the alignment of doors 72, 74 and 76. Details of the rows can be seen by reference to middle row 80 and upper row 82, illustrated by the cutaway areas of FIGS. 5 and 6. In FIGS. 5 and 6, middle row 80 is shown having no canisters and upper row 82 is shown loaded with canisters 90. Typically, each horizontally extending canister row will be loaded or nearly loaded with canisters 90 during operation of the kiosk. Middle row 80 is shown empty of canisters to better illustrate components of the current embodiment.

Figure 7:
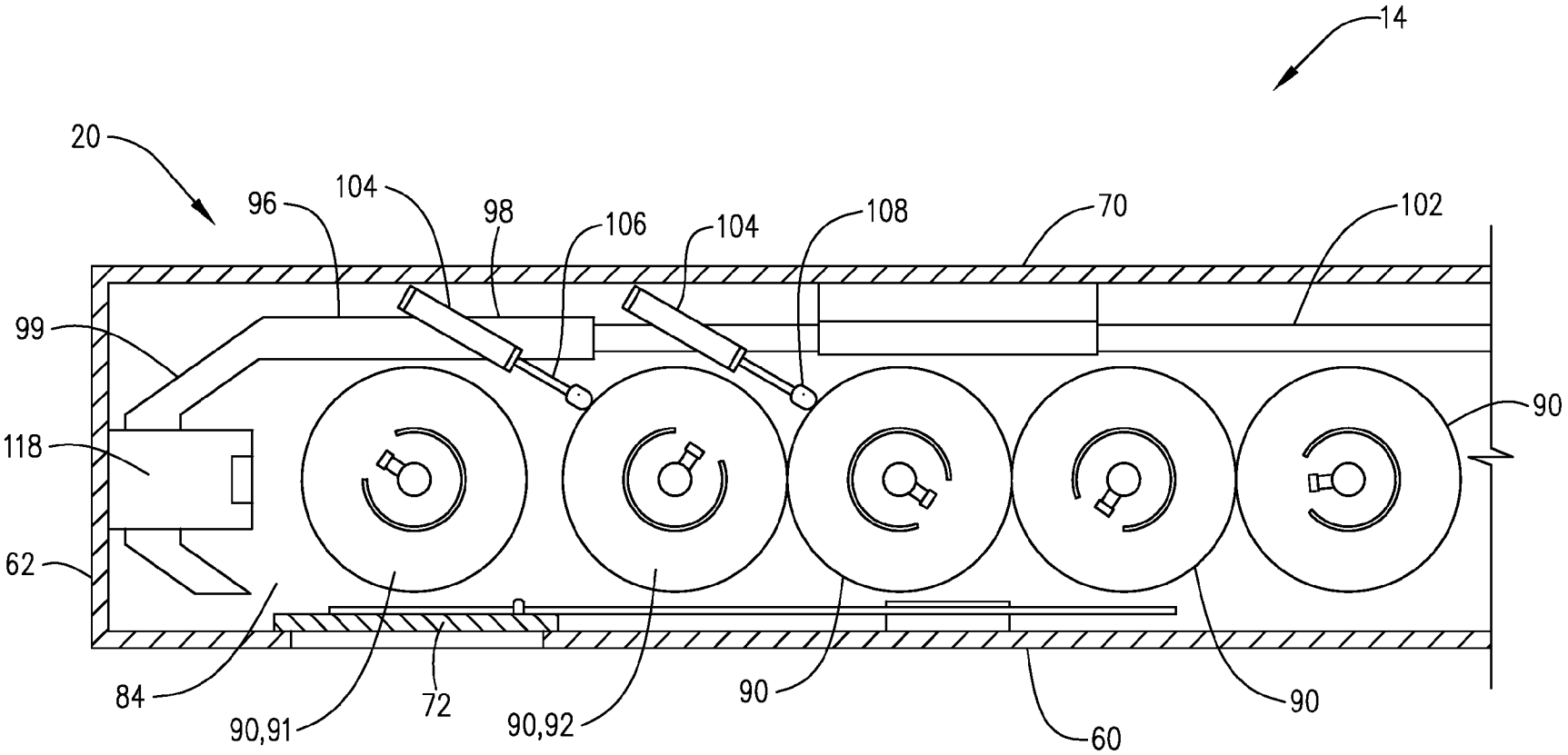
FIG. 7 is a top sectional view of the canister storage compartment taken along line 7-7 of FIG. 5.

As will be appreciated by reference to FIGS. 5 and 7, each receiving door 72 is associated with a horizontally extending canister row and provides access to a receiving space or zone 84 on the associated row. During operation of the kiosk, receiving space 84 will typically be empty, except for during and immediately after the placement of a return canister (typically an empty container) into receiving space 84, as further explained below and shown in FIG. 7. As will be appreciated by reference to FIG. 6, each dispensing door 76 is associated with a horizontally extending canister row and provides access to a dispensing space or zone 86. During operation of the kiosk, dispensing space 86 will typically contain a canister, except immediately after removal of a full canister, as further explained below. Maintenance doors 74 will typically be open only during maintenance of the canister storage compartment 14 and each maintenance door 74 opens up to allow access to an associated horizontally extending canister row. As used herein the term "horizontally extending" means substantially horizontal but can allow for some slope downwards from the receiving end to the dispensing end. Such slope will be less than 10 degrees. Generally, the slope will be less than 5 degrees, typically less than 2 degrees, more typically less than 1 degree and preferably will be about 0 degrees.

Each horizontally extending canister row has a deck 94 on which canisters 90 can sit and can be moved. Generally, deck 94 can be a smooth solid plane surface allowing the sliding of canisters 90 without a mechanical friction reduction means; however, it is within the scope that deck 94 can incorporate rollers, tread belts or other movement facilitators. The height of each horizontally extending canister row should be sufficient to clear the top of the canister without contact with the top of the canister but should be close enough to the top of the canister so as to prevent circumvention the canister locks and, thus allow removal of canisters not in dispensing space 86.

As illustrated in FIGS. 5 and 7, the canisters 90 are placed on a horizontally extending canister row so as to form a line of canisters generally extending from proximate the receiving end 20 to proximate the dispensing end 22. The receiving end 20 of each horizontally extending canister row has a canister pusher 96, one or more canister locks 104, one or more canister sensors 118 and a door sensor 120. Canister pusher 96 has a pusher arm 98, an arm mount 100 and hydraulic piston 102. Arm mount 100 is mounted so as to be stationary relative to the associated horizontally canister extending row. Pusher arm 98 is slidingly received on arm mount 98. Both pusher arm 98 and arm mount 100 are oriented such that pusher arm 98 can move horizontally along the horizontally extending canister row approximately mid-way of the canister height. Hydraulic piston 102 is connected to pusher 98 so that movement of the piston moves pusher arm 98 horizontally along the horizontally extending canister row. In the figures, pusher arm 98 is in its non-activated state wherein its hand portion 99 is at receiving end 20 on the opposing side of receiving space 84 from dispensing end 22. When pusher arm 98 is activated, hydraulic piston 102 moves piston arm 98 towards dispensing end 22 to contact the canister in or closest to the receiving space. After contact, the pusher arm is moved further towards the dispensing end 22 to push the canister in or closest to the receiving space and thus push or move the line of canisters towards the dispensing end 22 until a canister 117 is slid into dispensing space 86; at which point, hydraulic piston 102 returns pusher arm 98 to its non-activated state. As will be appreciated from FIG. 7, typically a return canister 91 will be in receiving space 84 when pusher arm 96 is activated; thus, the canister contacted by pusher arm 98 will be return canister 91; however, at times no return canister will be in receiving space 84, then the canister contacted will be the canister adjacent to the receiving space canister 92. If no canister is adjacent to the receiving space 84 then the next canister towards the dispensing end will be the canister contacted by pusher arm 98 and so on until the pusher arm 98 is not able to contact a canister on which it can exert a force to push the line of canisters towards the dispensing end 22. Accordingly, as used herein the phrase "in or closest to the receiving space" refers to a canister in the receiving space or, if no canister is in the receiving space, the canister closest to the receiving space and on the horizontally extending canister row associated with the receiving space. Typically, the pusher arm 98 is designed to only contact and exert the pushing force on a canister in the receiving space (canister 91) or in the space adjacent to the receiving space (canister 92) and if neither canister 91 or 92 is present, then automated teller takes the horizontally extending canister row out of the set of canister rows available for selection during a transaction, as described below.

To prevent unauthorized removal of canisters 90 from the receiving doors 72, receiving end 20 has one or more canister locks 104. Each canister lock 104 has a lock mode in which it prevents a canister from being moved in at least one direction (typically towards receiving door 72) and an unlock mode where it does not prevent canister movement. Typically, there will be at least one canister lock 104 located proximate to the receiving end 20 such that it can prevent the canister adjacent to the receiving space 84 from being removed. In this context, "adjacent" means closest to but not in receiving space 84. Other canisters in the line of canisters subsequent to the canister adjacent to receiving space 84 can also be provided with canister locks. Each canister lock 104 can be a hydraulic piston lock that engages a canister when the receiving door 72 is open (lock mode) and disengage the canister when receiving door 72 is closed (unlock mode) so as to not interfere with the sliding of the canister line by canister pusher 96. Automated teller 12 controls canister locks 104 as described below. As illustrated in FIGS. 5 and 7, canister locks 104 have a retracted position where lock arm 106 is retracted and tip 108 does not contact a canister (as shown by FIG. 5, middle row 80) and an extended position where lock arm 106 is extended and tip 108 contacts a canister (as shown by FIG. 5, top row 82, and FIG. 7), which correspond to the unlock and locked mode, respectively. Preferably, at least two canister locks 104 are provided to lock canisters 91 and 92 against movement.

Similarly, dispensing end 22 is also provided with one or more canister locks 110. Each canister lock 110 has a lock mode in which it prevents a canister from being moved in at least one direction (typically towards dispensing door 76) and an unlock mode where it does not prevent canister movement. Typically, there will be at least one canister lock 110 located proximate to the dispensing end 22 such that it can prevent the canister adjacent to the dispensing space 86 from being removed. In this context, "adjacent" means closest to but not in dispensing space 86. Other canisters in the line of canisters prior to the canister adjacent to dispensing space 86 can also be provided with canister locks. Each canister lock 110 can be a hydraulic piston lock that engages a canister when the dispensing door 76 is open (lock mode) and disengage the canister when dispensing door 76 is closed (unlock mode) so as to not interfere with the sliding of the canister line by canister pusher 96. Automated teller 12 controls canister locks 110 as described below. As illustrated in FIG. 7, canister locks 110 have a retracted position where lock arm 112 is retracted and tip 114 does not contact a canister (as shown by FIG. 6, middle row 80) and an extended position where lock arm 112 is extended and tip 114 contacts a canister (as shown by FIG. 6, top row 82), which correspond to the unlocked and locked mode, respectively. Preferably, at least one canister lock 110 is provided to lock canister 116, which is adjacent to the dispensing space 86, against movement.

Additionally, receiving end 20 can be fitted with one or more canister sensors 118. Canister sensors 118 detect the presence of a return canister, typically, by detecting the height and/or shape of an object placed in the receiving space 84. Generally, canister sensors 118 can also detect other attributes of the object such as whether it is composed of metal. Canister sensors 118 send a signal to automated teller 12 based on the attributes detected so that automated teller 12 can verify that a return canister has been placed into receiving space 84 and not some other object. Generally, at least two canister sensors 118 will be utilized at receiving end 20 to better verify that a true canister is present. Dispensing end 22 can be fitted with at least one canister censor 118 so that automated teller 12 can verify when a full canister is removed from dispensing space 86.

Receiving end 20 and dispensing end 22 can be fitted with one or more door sensors 120. As illustrated, door sensors 120 are placed proximate to receiving doors 72 and dispensing doors 76 and inside canister storage compartment 14 such that they can detect whether the doors are open or closed and send a signal to automated teller 12.

Figure 8:
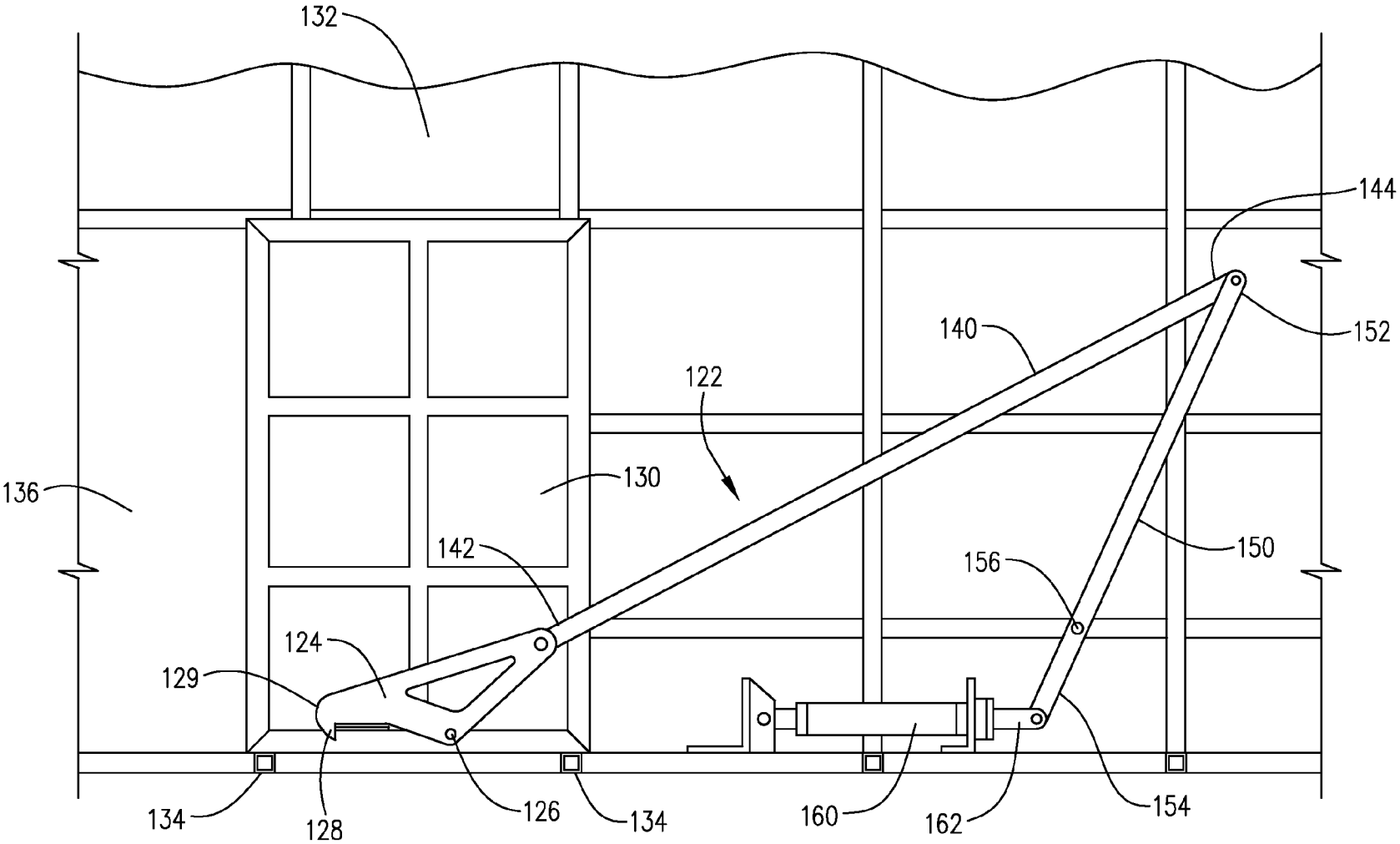
FIG. 8 is a view of a door and door opener from a point of view within the canister storage compartment.
Figure 5:
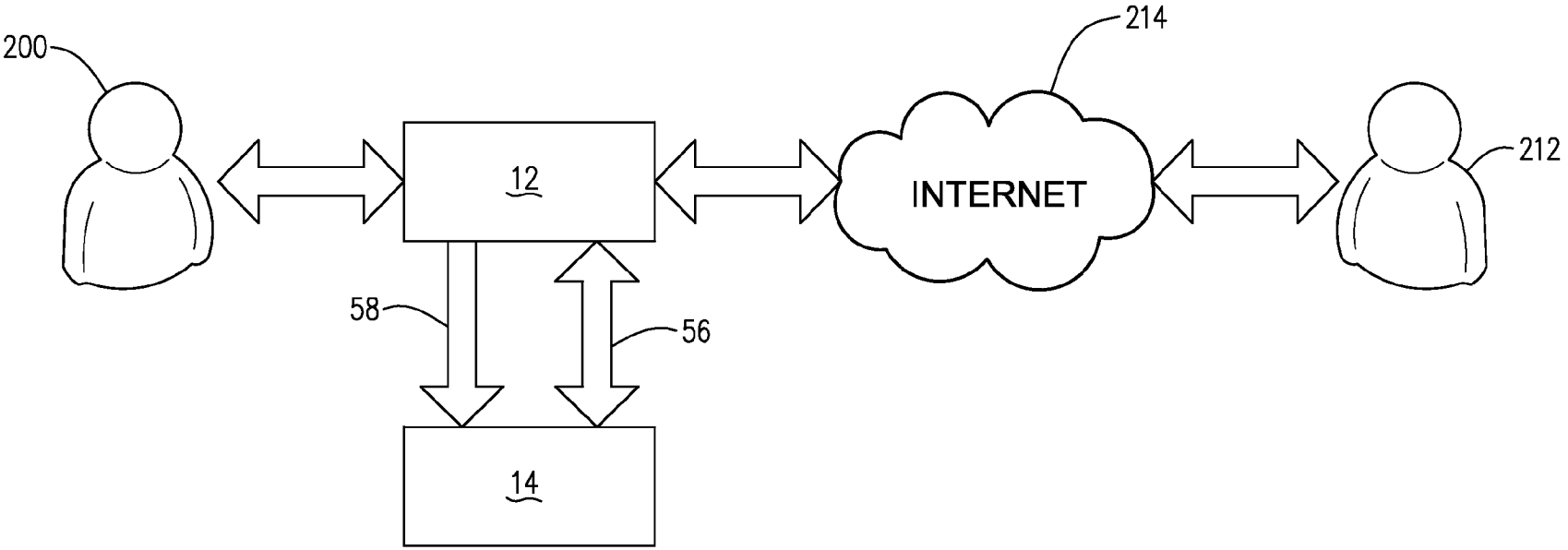

Each dispensing door 76 and each receiving door 72 can be connected to a door opener 122, such as illustrated in FIG. 8. Door opener 122 comprises a ratcheting claw 124, a first arm 140, a second arm 150 and a pneumatic piston 160. Ratcheting claw 124 has head 129 defining a claw 128 thereon. Ratcheting claw 124 is pivotally attached to a door 130, which can be either dispensing door 76 or receiving door 72, such that ratcheting claw 124 can pivot about pivot point 126. Door 130 slidingly engages frame 132 so that it can move horizontally between an open and closed position.

First arm 140 has a first end 142 pivotally connected to ratcheting claw 124. First arm 140 has a second end 144 pivotally connected to first end 152 of second arm 150. Second arm 150 has second end 154 pivotally connected to pneumatic piston 160. Also, second arm 150 is pivotally attached at a pivot point 156 between first end 152 and second end 154 to a stationary point such as a point on frame 132. Door opener 122 is connected to automated teller 12 such that automated teller 12 can open or close a door by providing a pneumatic signal that activates pneumatic piston 160. When pneumatic piston 160 is provided a pneumatic signal to extend piston arm 162, the extension of arm 162 causes second arm 150 to pivot about pivot point 156 and, thus, move first end 152 of second arm 150 towards door opening 136 in frame 132. The movement of first end 152 causes first arm 140 to move towards door opening 136 and, thus, cause ratcheting claw 124 and door 130 to move to a closed door position. Additionally, the movement of first arm 140 towards door opening 136 causes ratcheting claw 124 to pivot about pivot point 126 and be downwardly biased. Thus, as door 130 closes, claw 128 of ratcheting claw 124 catches in a ratchet catch defined in or attached to frame 132 thereby preventing door 130 from being forced back to an open position during closing or once closed. In this manner, door 130 is locked from moving back to an open state after the door has partially moved towards closing. The ratchet catch can be any suitable such device, such as holes 134 defined in frame 132 or a ratcheting teeth (not shown) defined in or attached to frame 132. Ratchet head 129 is rounded such that movement of the door to the closed position is not impeded by claw 128. When pneumatic piston 160 is provided a pneumatic signal to retract piston arm 162, the retraction of arm 162 causes second arm 150 to pivot about pivot point 156 and, thus, move first end 152 of second arm 150 away from door opening 136. The movement of first end 152 causes first arm 140 to move away from door opening 136 and, thus, cause ratcheting claw 124 and door 130 to move to an open door position. Additionally, the movement of first arm 140 away from the door causes ratcheting claw 124 to pivot about pivot point 126 and be upwardly biased. Thus, as door 130 opens, claw 128 of ratcheting claw 124 is positioned away from the ratcheting catch, for example holes 134, such that claw 128 does not catch in them. While the door opener 122 has been described for horizontal sliding of the door, it will be readily apparent from this disclosure that other arrangements and orientations could be used.

Turning now to FIG. 9, a diagram illustrating an overview of the use of one embodiment of the self-service kiosk is shown. Customer 200 inputs information regarding his canister purchase into automated teller unit 12. The customer can input the information to automated teller unit 12 through means known in the art, such as a key pad. The information can include whether he has a return canister and if he needs preferential access to the lower rows of canister storage compartments 14, such as if the customer has disabilities or limitations that prevent use of the upper rows of canister storage compartments 14. Automated teller 12 can in turn communicate with customer 200 such as by a view screen or printout to inform the customer which row and/or door to use for canister return or to retrieve a full canister and to provide a receipt to the customer. Automated teller unit 12 communicates with elements of canister storage compartment 14 through pneumatic lines 58 and electrical lines 56. Thus, automated teller unit 12 can have a pump and pneumatic distributor manifold 210 (shown in FIG. 3) to provide pneumatic signals to pneumatic elements of canister storage compartment 14, such as canister pusher 96, canister locks 104 and door opener 122 via pneumatic lines 58. Additionally, automated teller 12 can receive signals from canister sensors 118 and door sensors 120 via electrical lines 56. Automated teller unit 12 can monitor canister storage compartment 14 based on the transactions that occur and the signals received and can send a signal to a predefined address based on the monitoring. The signal can indicate when the canisters in the canister storage compartments 14 need to be replaced based on the number of empty spaces in each horizontally extending canister row and the number of return canisters in each horizontally extending canister row. For example, automated teller unit 12 can be in electronic communication with an operator 212 through the internet 214, phone lines or other similar electronic communication such that operator 212 can receive status updates on the self-service kiosk's operation and be notified when predetermined criteria indicate that maintenance is required for the self-service kiosk. The predetermined criteria can include the number of full canisters remaining in the canister storage compartments, the number or rows that are available for selection and operational errors occurring with the kiosk.

Figure 10A:
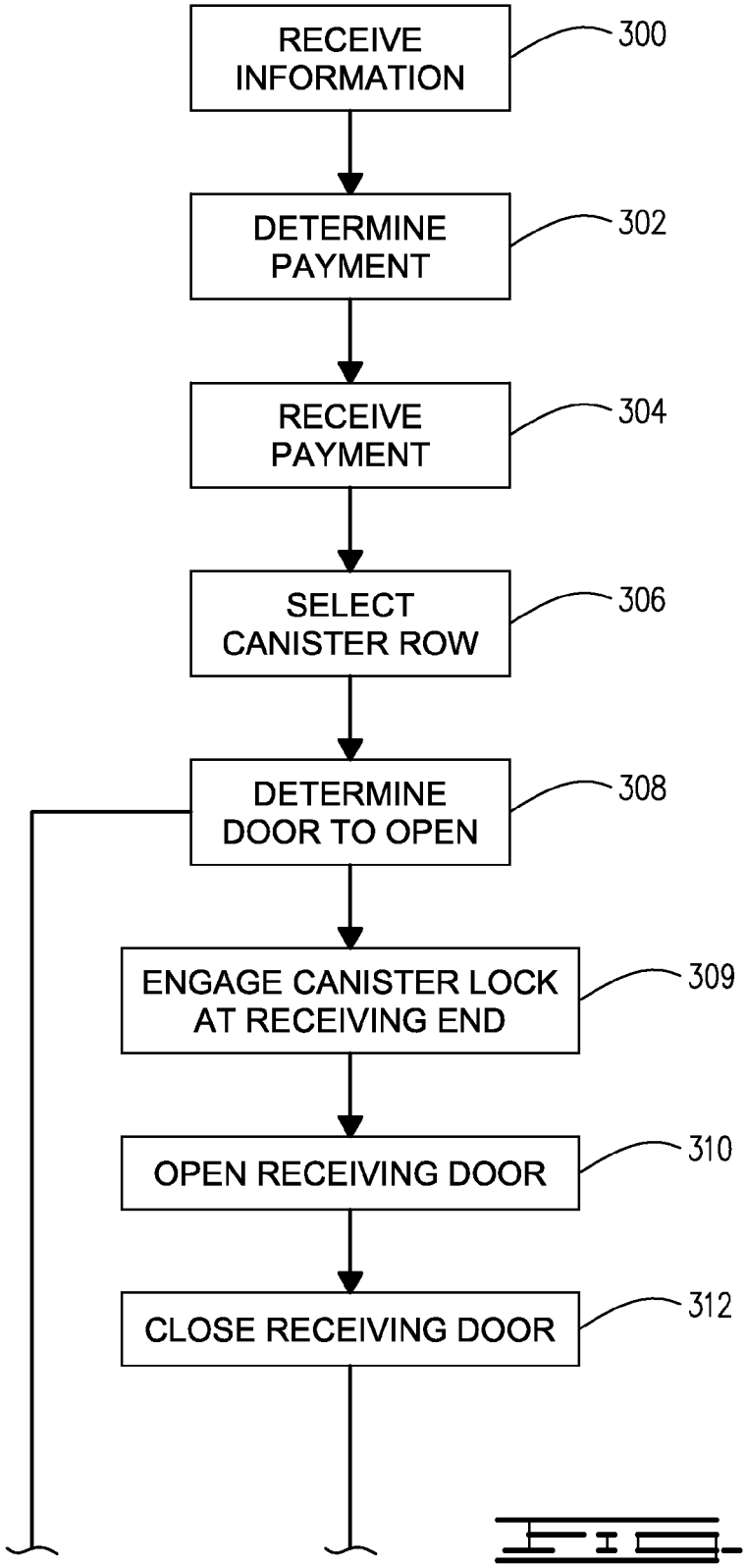
FIGS. 10A and 10B are a diagram illustrating the general process of operation of a self-service kiosk in accordance with one embodiment.
Figure 10B:
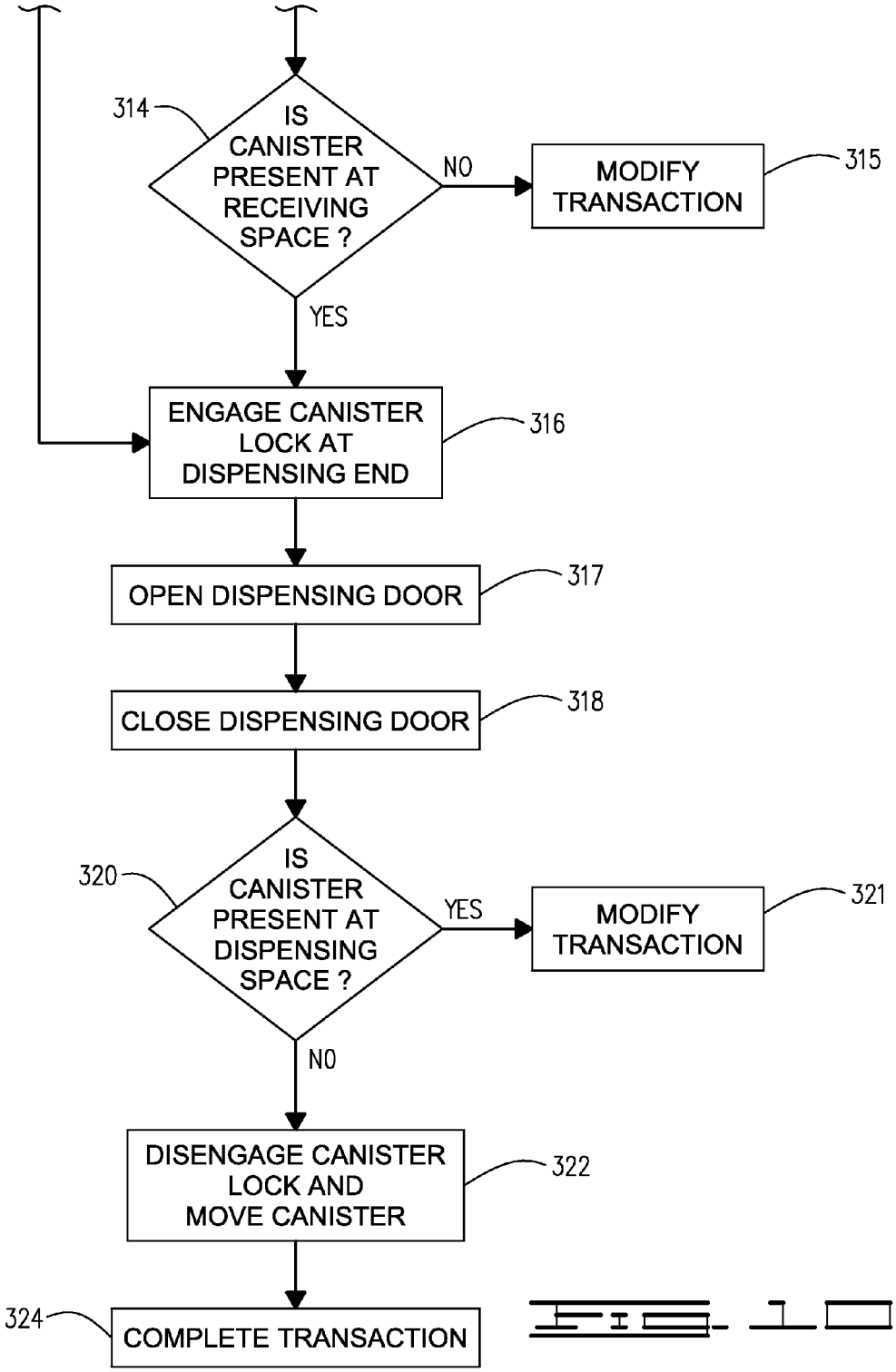

Turning now to FIG. 10, the operation of a self-service kiosk 10 in accordance with an embodiment will be further described. A series of instructions or information is received at an automated teller in step 300. Based on the information, automated teller determines the appropriate amount of payment in step 302. Payment is then received from the customer in step 304; thus, initiating a canister transaction in which a full canister is purchased either with or without an empty canister being returned. Payment will generally be by a payment card such as a credit card or debit card, but the automated teller could be configured to handle cash transactions or other forms of payment. Automated teller selects a canister row from a set of canister rows comprising one or more of the horizontally extending canister rows, which are available for selection. The selection can be based on the information provided by the customer in step 306. The set of canister rows available for selection is determined based on the current status of all the horizontally extending canister rows. Canister rows which do not contain any full canisters are removed from the set of rows. Further, based on the instructions received from the customer and the current status of the canisters, additional canister rows can be removed from the set of canister rows. The current status of the canisters can include the number of full tanks left in the row, the number of empty canisters in a row and the number of empty spaces in a row. The last being generally when canisters have been purchased but there has been no return canister. During each canister transaction, the automated teller monitors the number of empty canister spaces in each canister row and the number of return canisters in each canister row. Based on the monitoring, the automate teller removes one or more canister rows from the set of canister rows available for selection. The empty canister spaces are spaces available to hold canisters in each horizontally extending canister row but which do not contain canisters and, because the canisters are typically pushed towards the dispensing end 22, will generally be located near the receiving end 20.

For example, in an embodiment where there is a single canister storage compartment having three horizontally extending canister rows, each capable of holding seven canisters and having an empty receiving space, at the start of use of the kiosk after being loaded with canisters, each horizontally extending canister row would have seven full canisters and the set of canisters would be all three horizontally extending canister rows. If a first customer purchases a canister from the top horizontally extending canister row but has no return canister, then after the purchase the top row would contain only six canisters. Typically, the pusher arm will require a minimum number of canisters in a row to work. Thus, in this example, if the pusher arm requires six canisters to work, then, for a second customer, the set of canister rows would still consist of all three horizontally extending canister rows. However, the automated teller would choose the middle and bottom rows instead of the top row, if the series of instructions from the second customer indicates that the customer does not have a return canister. This selection maintains all three rows in a working configuration. If the series of instructions from the second customer indicates that the customer has a return canister, then the automated teller could choose the top row to maximize the useful life of the two full rows (the middle row and the bottom row). If in the course of use, a row is reduced to having five canisters, then that row would be removed from the set of canister rows available for selection. Additionally, if in the course of use, a row is reduced to having only return canisters and no full canisters, then that row would be removed from the set of canister rows available for selection.

As will be apparent from the above example, after a set of canister rows has been determined, the canister row selected can be further determined by the customer provided instructions. In addition to whether there is a return canister, other information in the instructions from the customer may determine the canister row selection. Accordingly, if the customer indicates in the instructions a preference for lower row, such as by instructing handicap access is needed, the automated teller could select a bottom or middle canister row. Alternatively, if no handicap access is indicated then the automated teller could choose a top canister row to keep lower rows available for purchasers indicating handicap access is needed.

In step 308, the automated teller determines whether to open a receiving door or a dispensing door on the selected canister row. If the instructions from the customer indicate that a canister is to be returned, then automated teller proceeds to step 309 and 310. If the instructions from the customer indicate that there is no return canister, then automated teller proceeds to step 316.

In step 309, the automated teller sends a signal to the canister locks at the receiving end to lock the canisters adjacent to the receiving space of the selected canister row. Once the canister lock has engaged or moved to the lock mode, the automated teller sends a signal to the door opener to open the receiving door of the selected canister row in step 310. Opening the receiving door provides access to a receiving space where the customer can place the return canister. Afterwards, the automated teller sends a signal to the door opener to close the receiving door in step 312. The customer can input at the automated teller that the return canister is in place so that the door can be closed. Also, automated teller can close the door after a predetermined period of time has elapsed from the opening of the door if it has not received the input from the customer that the canister is in place. In an additional embodiment, the automated teller closes the door after the canister sensor detects that a canister is in the receiving space or after the predetermined period of time has elapsed, whichever occurs first.

After the receiving door is closed in step 312 or concurrently with the closing, the automated teller determines if there is a receiving canister in the receiving space in step 314. If a canister is detected as being in the receiving space, the process proceeds on to step 316. If no canister is detected as being in the receiving space, then the canister transaction can be modified in step 315. Modifying the canister transaction can comprise terminating or canceling the entire current canister transaction, or requesting additional instructions from the customer so as to determine whether to change the canister transaction, such as by reopening the receiving door to allow additional time to place a return canister in the receiving space, or by canceling the canister return portion of the current canister transaction and proceeding to the dispensing portion of the current transaction in step 316.

In step 316, the automated teller sends a signal to the canister lock at the dispensing end to lock the canister adjacent to the dispensing space of the selected canister row. Once the canister lock has engaged or moved to the lock mode, the automated teller sends a signal to the door opener so that the dispensing door of the selected canister row is opened in step 317. This allows access to a full canister in the dispensing space of the selected canister row. After step 317, the automated teller sends a signal to the door opener to close the dispensing door in step 318. Closing the dispensing door can be done by the automated teller after the canister sensor at the dispensing end no longer detects a canister in the dispensing space. Optionally, the dispensing door can be closed after a predetermined period of time from the opening of the dispensing door, whether a canister is still detected nor not. Also, the dispensing door can be closed by the customer inputting a close door command into the automated teller.

After the dispensing door is closed in step 318 or concurrently with the closing, the automated teller determines if there is a canister in the dispensing space in step 320. If no canister is detected as being in the dispensing space, the process proceeds on to step 322. If a canister is detected as being in the dispensing space, then the canister transaction can be modified in step 321. Modifying the canister transaction can comprise terminating or canceling the entire current canister transaction, or requesting additional instructions from the customer so as to determine whether to change the canister transaction, such as by reopening the dispensing door to allow additional time to retrieve the full canister from the dispensing space.

In step 322, the canister locks are changed to the unlocked mode and the canister in or closest to the receiving space is moved towards the dispensing space such that the line of canisters in the selected row are moved towards the dispensing space and the receiving space does not contain a canister. Typically, the movement of the canisters is performed by the automated teller sending a signal to the canister pusher such that the pneumatic piston of the canister pusher engages the pusher arm to push the canisters. The canister locks can be unlocked or disengaged from the canisters at any time after the closure of the appropriate door and before moving the canisters; thus, the canister lock at the receiving end can be unlocked after step 312. The canister locks are typically unlocked by the automated teller sending a pneumatic signal to the pneumatic pistons of the canister locks. The process completes the canister transaction in step 324, which can include printing a receipt for the customer either prior to, during or after step 322.

For deployment, the self-service kiosk can be placed in the transportation mode by sliding the automated teller unit 12 next to a canister storage unit 14 such that first and second brace beams 24 and 26 and tube 28 slide into the canister storage unit 14. In the transportation position brace beams 24 and 26 and tube 28 remain engaged with automated teller unit 12 and automated teller unit 12 is adjacent to the canister storage unit as shown in FIG. 2. The kiosk can then be loaded onto a trailer for transportation in a conventional manner. Once loaded, the kiosk can be transported to an installation site having a ground surface. The kiosk is next unloaded onto said ground surface, which will typically be a prepared surface, such as a paved area. After unloading, the automated teller unit 12 can be placed into the dispensing position, the automated teller 12 is slid away from the canister storage unit with first and second brace beams 24 and 26 and tube 28 remaining engaged with the automated teller unit 12 at one end and the canister storage unit at another end. In the dispensing position, the automated teller unit 12 will generally be spaced more than about 60 inches from the nearest canister storage compartment 14. Typically, the automated teller unit 12 will be spaced from 60 inches to 240 inches from the nearest canister storage compartment 14 and, more typically, about 60 inches from the nearest canister storage unit.

Once in the dispensing position, the automated teller unit 12 can be locked from moving from the dispensing position as described above. Additionally, other canister storage units can be connected to the automated teller unit 12 as previously described.

Some embodiments in accordance with the above description will now be described. In one embodiment there is a process for dispensing canisters comprising the steps of:

(a) receiving a payment at an automated teller spaced apart from one or more canister storage compartments, wherein each such canister storage compartment has a plurality of horizontally extending canister rows configured to hold at least three canisters such that there is a line of canisters along the row, wherein the payment initiates a canister transaction;

(b) receiving a series of instructions at the automated teller including whether a return canister will be returned and, if no return canister is to be returned, skipping steps (d), (e) and (f);

(c) selecting a canister row from a set of canister rows, wherein the set of canister rows comprises one or more of the horizontally extending canister rows;

(d) opening a first door at a receiving end of the selected row of the canister storage compartment, wherein the receiving end has a receiving space suitable to receive the return canister;

(e) closing the first door;

(f) detecting whether the return canister is present in the receiving space and continuing to step (g) if the return canister is detected or proceeding to step (j) if no return canister is detected;

(g) opening a second door at a dispensing end of the selected row to allow access to a full canister in a dispensing space;

(h) closing the second door;

(i) detecting whether the full canister is in the dispensing space and if the full canister is still detected proceeding to step (j); and (j) modifying the canister transaction if no return canister is detected in step (f) or if the full canister is detected in step (i).

In step (e) of the above process the first door can be closed upon receiving a closed door signal at the automated payment center or after a first predetermined period of time has elapsed. Further, in step (h) the second door can be closed after the full canister is no longer detected in the dispensing space or after a second predetermined period of time has elapsed.

Also, the automated teller can be located between 60 inches and 240 inches from the nearest of one or more canister storage compartments.

The above process can further comprise moving the canister in or closest to the receiving space in the selected row towards the dispensing space after step (h) such that the line of canisters is moved towards the dispensing space and the receiving space does not contain a canister. Further, the canister adjacent to the receiving space can be locked against movement towards the receiving space during the period of time the first door is open. In this context, "adjacent" means closest to but not in the receiving space. Also, the canister adjacent to the dispensing space can be locked against movement towards the dispensing space during the period of time the second door is open. In this context, "adjacent" means closest to but not in the dispensing space.

During the closing of the first door in step (e) of the process, the first door can be locked from moving back to an open state after the first door has partially moved towards closing. Also, during the closing of the second door in step (h) of the process, the second door can be locked from moving back to an open state after the second door has partially moved towards closing.

The canister row can be selected in step (c) of the above process based on the series of instructions received in step (b). Further, the process can include monitoring the number of empty canister spaces in each canister row and monitoring the number of return canisters in each canister row. The process can further comprise removing a canister row from the set of canister rows available for selection based on the monitoring steps. Also, the process can comprise sending a signal to a predefined address based on the monitoring steps. The signal can indicate when the canisters in the canister storage compartments need to be replaced based on the number of empty spaces in each canister row and the number of return canisters in each canister row.

In accordance with the above, one specific embodiment is a process for dispensing canisters comprising:

(a) receiving a payment at an automated teller located between 60 inches and 240 inches from the nearest of one or more canister storage compartments, wherein each such canister storage compartment has three horizontally extending canister rows configured to hold at least three canisters such that there is a line of canisters along the row, wherein the payment initiates a canister transaction;

(b) receiving a series of instructions at the automated teller including whether a return canister will be returned and, if no return canister is to be returned, skipping steps (d) and (e);

(c) selecting a canister row from a set of canister rows based on the series of instructions received in step (b), wherein the set of canister rows comprises one or more of the horizontally extending canister rows;

(d) opening a first door at a receiving end of the selected row of the canister storage compartment, wherein the receiving end has a receiving space suitable to receive the return canister;

(e) closing the first door and continuing to step (f) if the return canister is detected or proceeding to step (i) if no return canister is detected, wherein the first door is closed upon receiving a closed door signal at the automated payment center or after a first predetermined period of time has elapsed;

(f) opening a second door at a dispensing end of the selected row to allow access to a full canister in a dispensing space;

(g) closing the second door when the full canister is no longer detected in the dispensing space, or, if a second predetermined period of time has elapsed at the end of which the full canister is still detected, closing the first door and proceeding to step (i);

(h) moving the canister in or closest to the receiving space towards the dispensing space such the line of canisters is moved towards the dispensing space and the receiving space does not contain a canister;

(i) modifying the canister transaction if no return canister is detected in step (e) or if the first predetermined period of time or second predetermined period of time is exceeded;

(j) locking the canister closest to the receiving space against movement towards the receiving space during the period of time the first door is open;

(k) locking the canister adjacent to the dispensing space against movement towards the dispensing space during the period of time the second door is open;

(l) during the closing of the first door in step (e), locking the first door from moving back to an open state after the first door has partially moved towards closing;

(m) during the closing of the second door in step (g), locking the second door from moving back to an open state after the second door has partially moved towards closing;

(n) monitoring the number of empty canister spaces in each canister row;

(o) monitoring the number of return canisters in each canister row;

(p) removing a canister row from the set of canister rows available for selection based on steps (n) and (o); and (q) sending a signal to a predefined address based on steps (n) and (o), wherein the signal indicates when the canisters in the canister storage compartments need to be replaced based on the number of empty spaces in each canister row and the number of return canisters in each canister row.

In another embodiment there is provided a self-service kiosk for storing and dispensing canisters. The kiosk comprises an automated teller and a canister storage compartment. The canister storage compartment has a series of walls defining an enclosure for storage and dispensing of canisters. The series of walls includes a front wall.

Also, the canister storage compartment has a plurality of horizontally extending canister rows within the enclosure. Each row is configured to hold a line of at least three canisters and each row has a dispensing end defining a dispensing space and a receiving end defining a receiving space. The front wall has a receiving door at the receiving end of each row and a dispensing door at the dispensing end of each row. The kiosk can have a plurality of such canister storage compartments and each canister storage compartment can have three horizontally extending canister rows.

The canister storage compartment includes a canister pusher associated with each row such that the canister pusher can move the canisters in the row associated with it towards the dispensing end based on a moving signal from the automated teller.

Also, the canister storage compartment includes a first canister lock and a second canister lock associated with each row. The first canister lock has a lock mode and an unlock mode. The first canister lock is mounted in the enclosure and adjacent to the dispensing end such that, when in the lock mode, it prevents the canister adjacent to the dispensing space from being removed. The second canister lock has a lock mode and an unlock mode. The second canister lock is mounted in the enclosure and adjacent to the receiving end such that, when in the lock mode, it prevents the canister adjacent to the dispensing space from being removed. In this context, "adjacent means" closest to but not in the dispensing space or receiving space, as applicable.

Further, the canister storage compartment has a door opener associated with each dispensing door and each receiving door. The door opener opens or closes the associated door based on an opening signal from the automated teller.

The canister storage compartment can have a return sensor and dispensing sensor. The return sensor is associated with the receiving end of each row. The return sensor is configured to detect when a return canister is placed in the receiving space and send a return signal to the automated teller. The dispensing sensor is associated with the dispensing end of each row. The dispensing sensor is configured to detect when a canister has been removed from the dispensing space and send a dispensing signal to the automated teller.

The automated teller is in communication with each canister pusher such that it can send the moving signal, with each pneumatic door opener such that it can send the opening signal, with each return sensor such that it can receive the return signal and with each dispensing sensor such that it can receive the dispensing signal.

The self-service kiosk can further comprise a door lock associated with each dispensing door and each receiving door, which prevents the associated door from being forced open when the door is closing. Also, there can be a door sensor associated with each dispensing door and each receiving door. The door sensor can be configured to detect when the associated door is closed and send a door signal to the automated teller. The automated teller is in communication with each door sensor such that it can receive the door signal.

The automated teller of the self-service kiosk can be slidably connected to the canister storage compartment such that it has a transportation position adjacent to the canister storage compartment and a dispensing position where it is spaced 60 to 240 inches from the canister storage compartment. Also, the automated teller can be locked in the dispensing position to prevent movement of the automated teller towards the canister storage compartment. The automated teller can be configured to monitor empty containers and full containers in each horizontally extending canister row and can be configured to send a maintenance signal to a predefined address when predefined refill conditions are met.

In a further embodiment there is provided a method of deploying a self-service kiosk for storing and dispensing canisters. The kiosk comprises an automated teller unit and a first canister storage unit, the method comprising:

(a) transporting the kiosk to an installation site having a ground surface, wherein the automated teller unit is in a transportation position in which the automated teller unit is adjacent to the canister storage unit, the automated teller unit being slidably connected to the canister storage unit such that it has the transportation position and a dispensing position in which it is spaced 60 to 240 inches from the canister storage unit;

(b) placing the kiosk on the ground surface; and (c) placing the automated teller unit into the dispensing position.

The method of deployment can further comprise locking the automated teller unit from moving from the dispensing position to the transportation position after step (c). Also, the method can comprise connecting a second canister storage unit to the automated teller unit after step (b) and can further comprise connecting a third canister storage unit to the first canister storage unit and connecting a fourth canister storage unit to the second canister storage unit.

Further, the method can have the additional steps of placing the automated teller unit into the transportation position, and placing the kiosk onto a trailer for transportation.

In yet another embodiment there is provided a door apparatus comprising a door frame, a door, a pneumatic piston and a ratcheting claw. The door slidingly engages the door frame such that the door can be moved between an open position and a closed position. The pneumatic piston is configured to open and close the door. The ratcheting claw engages the door and door frame such that the ratcheting claw prevents the door from being forced to a fully open position from a partially closed position.

Further, the ratcheting claw can pivotally engage the door and can pivotally engage the pneumatic piston such that the ratcheting claw engages the door frame during closing of the door to prevent the door from being forced to a fully open position and does not engage the door frame during opening. The ratcheting claw can engage the door frame by interacting with one or more ratchet catches defined in the door frame. The door frame can include a base portion where the door moves horizontally from the open position to the closed position and the ratchet catch is defined in the base portion.

Further the ratcheted claw can be pivotally mounted to the door and engage the pneumatic piston by a first arm and a second arm, each having a first end and a second end. The first end of the first arm can be pivotally mounted to the ratcheted claw. The second end of the first arm can be pivotally mounted to the first end of the second arm. The second end of the second arm can be pivotally mounted to the pneumatic piston.

The second arm can be pivotally mounted at a point in between its first end and second end to a third stationary point.

While various embodiments have been shown and described herein, modifications may be made by one skilled in the art without departing from the spirit and the teachings herein. The embodiments described herein are exemplary only, and are not intended to be limiting. Many variations, combinations, and modifications are possible. Accordingly, the scope of protection is not limited by the description set out above, but is defined by the claims which follow, that scope including all equivalents of the subject matter of the claims.

What is claimed is:

1. A process for dispensing canisters comprising:

(a) receiving a payment at an automated teller associated with one or more canister storage compartments, wherein each such canister storage compartment has a plurality of horizontally extending canister rows configured to hold at least three canisters such that there is a line of canisters along said row, wherein said payment initiates a canister transaction;

(b) receiving a series of instructions at said automated teller including whether a return canister will be returned and, if no return canister is to be returned, skipping steps (d), (e) and (f);

(c) selecting a canister row from a set of canister rows, wherein said set of canister rows comprises one or more of said horizontally extending canister rows;

(d) opening a first door at a receiving end of said selected row of said canister storage compartment, wherein said receiving end has a receiving space suitable to receive said return canister;

(e) closing said first door;

(f) detecting whether said return canister is present in said receiving space and continuing to step (g) if said return canister is detected or proceeding to step (j) if no return canister is detected;

(g) opening a second door at a dispensing end of said selected row to allow access to a full canister in a dispensing space;

(h) closing said second door;

(i) detecting whether said full canister is in said dispensing space and if said full canister is still detected proceeding to step (j); and (j) modifying said canister transaction if no return canister is detected in step (f) or if said full canister is detected in step (i), wherein modifying said canister transaction includes one or more of the following: canceling the canister transaction such that steps (g)-(i) are not performed, requesting additional instructions, repeating steps (d)-(f), and repeating steps (g)-(i).

2. The process of claim 1, wherein in step (e) said first door is closed upon receiving a closed door signal at said automated payment center or after a first predetermined period of time has elapsed.

3. The process of claim 1, wherein in step (h) said second door is closed after said full canister is no longer detected in said dispensing space or after a second predetermined period of time has elapsed.

4. The process of claim 1, wherein said automated teller is spaced apart from said one or more canister storage compartments such that said automated teller is located between 60 inches and 240 inches from the nearest of said one or more canister storage compartments.

5. The process of claim 1 further comprising moving the canister in or closest to said receiving space in said selected row towards said dispensing space after step (h) such that said line of canisters is moved towards said dispensing space and said receiving space does not contain a canister.

6. The process of claim 1 further comprising locking the canister adjacent to said receiving space against movement towards said receiving space during the period of time said first door is open.

7. The process of claim 1 further comprising locking the canister adjacent to said dispensing space against movement towards said dispensing space during the period of time said second door is open.

8. The process of claim 1 further comprising during said closing of said first door in step (e), locking said first door from moving back to an open state after said first door has partially moved towards closing, and during said closing of said second door in step (h), locking said second door from moving back to an open state after said second door has partially moved towards closing.

9. The process of claim 1 further comprising monitoring the number of empty canister spaces in each canister row and monitoring the number of return canisters in each canister row.

10. The process of claim 9 further comprising removing a canister row from said set of canister rows available for selection based on said monitoring steps.

11. The process of claim 9 further comprising sending a signal to a predefined address based on said monitoring steps, wherein said signal indicates when said canisters in said canister storage compartments need to be replaced based on the number of empty spaces in each canister row and the number of return canisters in each canister row.

12. A process for dispensing canisters comprising:

(a) receiving a payment at an automated teller located between 60 inches and 240 inches from the nearest of one or more canister storage compartments, wherein each such canister storage compartment has three horizontally extending canister rows configured to hold at least three canisters such that there is a line of canisters along said row, wherein said payment initiates a canister transaction;

(b) receiving a series of instructions at said automated teller including whether a return canister will be returned and, if no return canister is to be returned, skipping steps (d) and (e);

(c) selecting a canister row from a set comprising one or more of said horizontally extending canister rows, which are available for selection, based on said series of instructions received in step (b);

(d) opening a first door at a receiving end of said selected row of said canister storage compartment, wherein said receiving end has a receiving space suitable to receive said return canister;

(e) closing said first door and continuing to step (f) if said return canister is detected or proceeding to step (i) if no return canister is detected, wherein said first door is closed upon receiving a closed door signal at said automated payment center or after a first predetermined period of time has elapsed;

(f) opening a second door at a dispensing end of said selected row to allow access to a full canister in a dispensing space;

(g) closing said second door when said full canister is no longer detected in said dispensing space, or, if a second predetermined period of time has elapsed at the end of which said full canister is still detected, closing said first door and proceeding to step (i);

(h) moving the canister in or closest to said receiving space towards said dispensing space such that said line of canisters is moved towards said dispensing space and said receiving space does not contain a canister;

(i) modifying said canister transaction if no return canister is detected in step (e) or if said first predetermined period of time or second predetermined period of time is exceeded, wherein modifying said canister transaction includes one or more of the following: canceling the canister transaction such that steps (f)-(h) are not performed, requesting additional instructions, repeating steps (d)-(e), and repeating steps (f)-(g);

(j) locking the canister closest to said receiving space against movement towards said receiving space during the period of time said first door is open;

(k) locking the canister adjacent to said dispensing space against movement towards said dispensing space during the period of time the second door is open;

(l) during said closing of said first door in step (e), locking said first door from moving back to an open state after said first door has partially moved towards closing;

(m) during said closing of said second door in step (g), locking said second door from moving back to an open state after said second door has partially moved towards closing;

(n) monitoring the number of empty canister spaces in each canister row;

(o) monitoring the number of return canisters in each canister row;

(p) removing a canister row from said set of canister rows available for selection based on steps (n) and (o); and (q) sending a signal to a predefined address based on steps (n) and (o), wherein said signal indicates when said canisters in said canister storage compartments need to be replaced based on the number of empty spaces in each canister row and the number of return canisters in each canister row.

13. A self-service kiosk for storing and dispensing canisters comprising:

an automated teller; and a canister storage compartment, wherein said canister storage compartment has:

a series of walls defining an enclosure for storage and dispensing of canisters, said series of walls comprising a front wall;

a plurality of horizontally extending canister rows within said enclosure, each said row configured to hold a line of at least three canisters and each said row having a dispensing end defining a dispensing space and a receiving end defining a receiving space and wherein said front wall has a receiving door at said receiving end of each row and a dispensing door at said dispensing end of each row;

a canister pusher associated with each row such that said canister pusher can push said canisters in the row associated with it towards said dispensing end based on a moving signal from said automated teller;

a first canister lock associated with each row and having a lock mode and an unlock mode, wherein said first canister lock is mounted in said enclosure and adjacent to said dispensing end such that, when in said lock mode, it prevents the canister adjacent to said dispensing space from being removed;

a second canister lock associated with each row and having a lock mode and an unlock mode, wherein said second canister lock is mounted in said enclosure and adjacent to said receiving end such that, when in said lock mode, it prevents the canister adjacent to said dispensing space from being removed;

a door opener associated with each dispensing door and each receiving door, which opens or closes the associated door based on an opening signal from said automated teller;

a return sensor associated with said receiving end of each row, said return sensor configured to detect when a return canister is placed in said receiving space and send a return signal to said automated teller; and a dispensing sensor associated with said dispensing end of each row, said dispensing sensor configured to detect when a canister has been removed from said dispensing space and send a dispensing signal to said automated teller; and wherein said automated teller is in communication with each said canister pusher such that it can send said moving signal, each said door opener such that it can send said opening signal, each said return sensor such that it can receive said return signal, and said dispensing sensor such that it can receive said dispensing signal.

14. The self-service kiosk of claim 13 further comprising a door lock associated with each dispensing door and each receiving door, which prevents the associated door from being forced open when the associated door is closing.

15. The self-service kiosk of claim 13 further comprising a door sensor associated with each dispensing door and each receiving door, said door sensor configured to detect when the associated door is closed and send a door signal to said automated teller and wherein said automated teller is in communication with each said door sensor such that it can receive said door signal.

16. The self-service kiosk of claim 13 wherein said automated teller is slidably connected to said canister storage compartment such that it has a transportation position adjacent to said canister storage compartment and a dispensing position where it is spaced 60 to 240 inches from said canister storage compartment.

17. The self-service kiosk of claim 16 wherein said automated teller can be locked in said dispensing position to prevent movement of said automated teller towards said canister storage compartment.

18. The self-service kiosk of claim 13 wherein said automated teller is configured to monitor empty containers and full containers in each horizontally extending canister row and is configured to send a maintenance signal to a predefined address when predefined refill conditions are met.

19. The self-service kiosk of claim 13 having a plurality of canister storage compartments and wherein each canister storage compartment has three horizontally extending canister rows.

20. A self-service kiosk for storing and dispensing canisters comprising:

an automated teller; and a plurality of canister storage compartments, wherein said canister storage compartments have:

a series of walls defining an enclosure for storage and dispensing of canisters, said series of walls comprising a front wall;

three horizontally extending canister rows within said enclosure, each said row configured to hold line of at least three canisters and each said row having a dispensing end defining a dispensing space and a receiving end defining a receiving space and wherein said front wall has a receiving door at said receiving end of each row and a dispensing door at said dispensing end of each row;

a canister pusher associated with each row such that said canister pusher can push said canisters in the row associated with it towards said dispensing end based on a moving signal;

a first pneumatic canister lock associated with each row and having a lock mode and an unlock mode, wherein said first pneumatic canister lock is mounted in said enclosure and adjacent to said dispensing end such that when in said lock mode it prevents a canister adjacent to said dispensing space from being removed;

a second pneumatic canister lock associated with each row and having a lock mode and an unlock mode, wherein said second pneumatic canister lock is mounted in said enclosure and adjacent to said receiving end such that when in said lock mode it prevents a canister adjacent to said receiving space from being removed;

a pneumatic door opener associated with each dispensing door and each receiving door, which opens or closes the associated door based on an opening signal from said automated teller;

a door lock associated with each dispensing door and each receiving door, which prevents the associated door from being forced open when the associated door is closing;

a door sensor associated with each dispensing door and each receiving door, said door sensor configured to detect when the associated door is closed and send a door signal to said automated teller;

at least two return sensors associated with said receiving end of each row, said return sensors configured to detect when a return canister is placed in said receiving space and send a return signal to said automated teller; and a dispensing sensor associated with said dispensing end of each row, said dispensing sensor configured to detect when a canister has been removed from said dispensing space and send a dispensing signal to said automated teller; and wherein said automated teller is slidably connected to one of said canister storage compartments such that it has a transportation position adjacent to said canister storage compartment and a dispensing position where it is spaced 60 to 240 inches from said canister storage compartment, and wherein said automated teller is in communication with each said canister pusher such that it can send said moving signal, each said pneumatic door opener such that it can send said opening signal, each said door sensor such that it can receive said door signal, each said return sensor such that it can receive said return signal and said dispensing sensor such that it can receive said dispensing signal and wherein said automated teller is configured to monitor empty containers and full containers in each horizontally extending canister row and is configured to send a maintenance signal to a predefined address when predefined refill conditions are met.

* * * * *